US005972502A

United States Patent [19]

Jessee et al.

[11] Patent Number: 5,972,502

[45] Date of Patent: Oct. 26, 1999

[54] SELF-CRIMPING FIBERS AND METHODS FOR THEIR PREPARATION

[75] Inventors: Robert Trigg Jessee, Axton; Donald Rittler Strachan, Martinsville, both of Va.

[73] Assignee: Optimer, Inc., Wilmington, Del.

[21] Appl. No.: 09/034,685

[22] Filed: Mar. 4, 1998

[51] Int. Cl.[6] ..... D02G 3/00

[52] U.S. Cl. ..... 428/370; 428/373; 428/374

[58] Field of Search ..... 428/370, 373, 428/374

[56] References Cited

U.S. PATENT DOCUMENTS

| | | | |
|---|---|---|---|
| 3,111,805 | 11/1963 | Boyer | 57/140 |
| 3,399,108 | 8/1968 | Olson | 161/173 |
| 3,536,802 | 10/1970 | Uraya et al. | 264/171 |
| 3,594,266 | 7/1971 | Okazaki et al. | 161/173 |
| 3,779,859 | 12/1973 | Olson | 161/173 |
| 4,106,313 | 8/1978 | Boe | 66/202 |
| 4,405,686 | 9/1983 | Kuroda et al. | 428/374 |
| 4,724,184 | 2/1988 | Killian et al. | 428/227 |
| 4,923,742 | 5/1990 | Killian et al. | 428/283 |
| 5,164,262 | 11/1992 | Kobayashi et al. | 428/373 |
| 5,364,694 | 11/1994 | Okada et al. | 428/373 |
| 5,372,885 | 12/1994 | Tabor | 428/373 |

FOREIGN PATENT DOCUMENTS 0 378 194 A2 7/1990 European Pat. Off. .

*Primary Examiner*—Newton Edwards

*Attorney, Agent, or Firm*—Woodcock Washburn Kurtz Mackiewicz & Norris LLP

[57] ABSTRACT

Novel self-crimping fibers and methods for their preparation. Embodiments are provided in which fibers are melt-spun from a non-elastomeric polyamide and a thermoplastic elastomer selected from the group consisting of a polyether block polyamide copolymer and a polycaprolactone polyester. The fibers may be knit or woven into textile articles including, inter alia, hosiery, pantyhose and stockings.

8 Claims, 1 Drawing Sheet

SELF-CRIMPING FIBERS AND METHODS FOR THEIR PREPARATION

FIELD OF THE INVENTION

The present invention relates to novel fibers and methods for their preparation. More particularly, the present invention relates to novel fibers which are self crimping and which may be useful in the preparation of textile articles.

BACKGROUND OF THE INVENTION

Ideal characteristics of leg wear, such as ladies hosiery, include such properties as: (1) lasting snug fit with quick recovery from stretch out and knee bending, (2) uniform translucent cosmetic appearance with minimum apparent stitch definition, (3) resistance to picks and snags, (4) high durability, and (5) a soft, smooth tactility. Leg wear also ideally possesses "one size fits all" properties, i.e., a wide range of leg sizes can ideally be fit with one hose size, without loss of comfort.

Efforts to impart the above properties to hosiery products have generally involved the use of yams which crimp in the fabrics, by knitting yarns with torque in S and Z directions in alternate courses, or by including a separate elastomer yarn in the hose. Various combinations of these methods have also been used. However, these methods have generally failed to provide hosiery products having the desired physical characteristics and/or have been generally extremely difficult to knit and/or process into satisfactory hosiery products.

Methods for making crimpable yarns have involved, for example, twisting or deforming the yarn or by using differential shrinkage in a two component fiber where the components are eccentrically arranged in the cross-section of the fiber. These techniques are described, for example, in U.S. Pat. Nos. 3,399,108 and 3,779,859. The yarns prepared by twisting, sometimes referred to as "torque yarns", generally have low fit range, poor recovery and exhibit noticeable stitch definition because they must be knit in alternate courses of S and Z directions. Crimpable yarns have also been made by combining together a hard, non-elastomeric polymer with an elastomeric polymer. The yarns prepared by this process, sometimes referred to as "composite" or "conjugate" yarns, are described, for example, in U.S. Pat. No. 4,106,313 and published European Patent Application No. 0 378 194 A2. U.S. Pat. No. 4,405,686 describes a conjugate filamentary yarn which is prepared from composite components including thermoplastic elastomer and non-elastomeric polyarnide or polyester. The yarns disclosed in U.S. Pat. No. 4,405,686 are composed of filaments whose cross-section is a compressed flat shape like a cocoon or oval. This compressed flat shape cross-section is disclosed as being necessary to obtain the highest degree of stretchability.

Hose produced by knitting an elastomeric yarn in combination with a hard yarn, for example, by covering or plaiting, may have good fit and recovery, but are generally difficult to knit.

Prior art yarns which are composed of composite filaments in a side-by-side configuration generally suffer from various drawbacks including, for example a tendency to separate at the interface of the components. In addition, the elastomeric portion of the composite fibers tends to stick to itself when in contact during processing and after packaging. The elastomeric component of the composite fibers also generally exhibits poor abrasion resistance. Prior art efforts to overcome these drawbacks have included spinning the elastomer as a core within a sheath of the hard component. However, the use of sheath-core technology may also be disadvantageous in that it is generally extremely difficult to control sheath thickness and eccentricity, and variations in sheath thickness often lead to non-uniform crimping and dyeing which, in turn, results in reduced yields of the yarns. Sheath core technology also requires highly complex and expensive sheath core spinning equipment and processes.

Prior art composite filamentary yarns must generally be heated and then cooled in a relaxed low-tension zone in order that further heat treatment in hose will develop crimp of an acceptable level. This is undesirable since the additional heat treatment step requires further processing of the fibers, resulting in a more complex process and an attendant increase in manufacturing costs.

Accordingly, new and/or better alternatives to prior art methods and compositions for achieving crimpable fibers and/or yarns are needed. The present invention is directed to this, as well as other important ends.

SUMMARY OF THE INVENTION

The present invention is directed generally to self-crimping fibers which may be useful in the preparation of textile articles. Specifically, in one embodiment, there is provided a self-crimping fiber which comprises a non-elastomeric polyarnide and a thermoplastic elastomer selected from the group consisting of a polyether block polyarnide copolymer and a polycaprolactone polyester.

Another aspect of the invention relates to a textile article which includes a portion that is knitted from fibers which are self-crimping and which comprise a non-elastomeric polyarnide and a thermoplastic elastomer selected from the group consisting of a polyether block polyarnide copolymer and a polycaprolactone polyester.

Yet another aspect of the invention relates to a method for the preparation of a self-crimping fiber. The method comprises melt spinning a non-elastomeric polyarnide and a thermoplastic elastomer selected from the group consisting of a polyether block polyarnide copolymer and a polycaprolactone polyester.

Still another aspect of the invention relates to a method for the preparation of a textile article. The method comprises providing self-crimping fibers which comprise a non-elastomeric polyarnide and a thermoplastic elastomer selected from the group consisting of a polyether block polyarnide copolymer and a polycaprolactone polyester. The fibers are knitted to provide the textile article.

Highly desirable and unexpected benefits are achieved with embodiments of the present invention. For example, the fibers described herein have superior and advantageous properties, including superior elastic recovery properties. The fibers of the present invention may be advantageously incorporated into textile articles, such as hosiery, having highly superior wear properties, including high power, excellent fit and recovery, and unusually wide fit ranges. The fibers of the present invention knit in a manner similar to hard yarns, and produce compact, unfinished (greige) textile articles with improved pick resistance. Textile articles prepared from the present fibers, especially hosiery, exhibit a substantially uniform translucent appearance (i.e., sheerness) when worn, with substantially no apparent stitch definition. The textile articles also demonstrate an extremely soft and smooth tactility with substantially no rubbery feel.

A particularly desirable and unexpected advantage of the present fibers is that they are self-crimping. The term "self-crimping", as used herein, means that the fibers may form crimps, including helical coil-like crimps, spontaneously, i.e., without the need of using elevated temperatures (referred to also as heat setting treatments), or other applied influences, such as the use of swelling agents, as is typically required with prior art composite fibers and yarns produced therefrom. Thus, even in the absence of elevated temperatures, the present fibers can be advantageously incorporated into textile products, including hosiery products, particularly ladies hosiery, having superior physical characteristics as described above. The fibers of the present invention may therefore be prepared using methods which may be simpler and/or more cost-effective as compared to methods employed in the preparation of prior art fibers.

These and other aspects of the invention will become more apparent from the present description and claims.

DETAILED DESCRIPTION OF THE INVENTION

Figure 1:
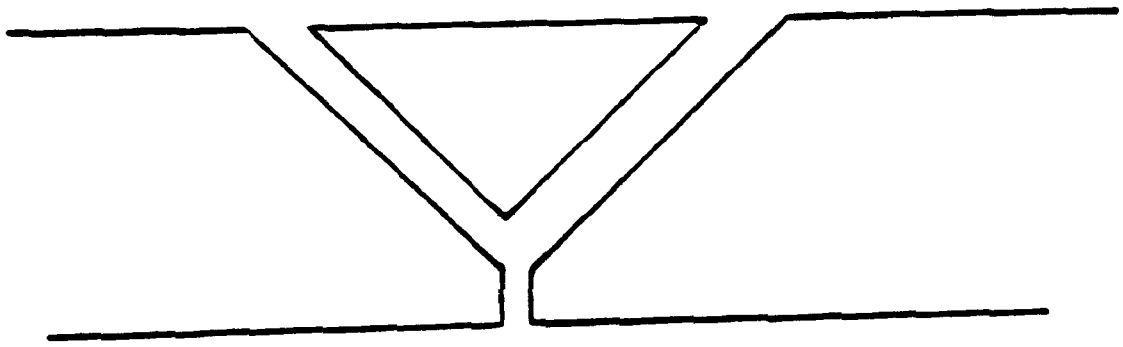
FIG. 1 is a schematic representation of a spinneret which may be used to melt spin fibers in accordance with an embodiment of the present invention.

The present invention is directed, in part, to melt-spun fibers and methods for their preparation. The fibers described herein may be assembled into multi-component yarns, and the fibers and/or yarns may be knitted or woven into textile articles including, for example, hosiery, pantyhose, stockings, panties, sportswear, and the like. The fibers of the present invention generally exhibit a higher effective and/or superior combination of physical properties, including elastic recovery properties. Since the fibers of the present invention are self-crimping, techniques such as heat setting treatments and the use of swelling agents, may be advantageously avoided. Thus, the present fibers and methods for their preparation may provide enhanced cost savings as compared to prior art fibers and methods for preparing prior art fibers.

In accordance with preferred embodiments of the present invention, the fibers are copolymeric, i.e., they are composed of two or more polymeric materials. In preferred form, the present fibers are biconstituent, i.e., they are composed of two different polymers. Also in accordance with preferred embodiments of the invention, the fibers are arranged in a side-by-side fashion. Certain prior art biconstituent fibers, such as those described in U.S. Pat. No. 4,405,686, are "modified" fibers. The term "modified", as used herein, refers to fibers whose cross-section is a compressed flat shape like a cocoon or oval. U.S. Pat. No. 4,405,686 teaches that this compressed flat shape cross-section is necessary to obtain the highest degree of stretchability in the disclosed fibers, and that the compressed flat shape requires the use of specialized spinneret equipment. As noted above, it is an unexpected advantage of the present invention that the fibers described herein are preferably "unmodified", i.e., the cross-section of the present fibers is preferably not characterized by a compressed flat shape, like a cocoon or oval. Thus, the present fibers may be prepared without the need for specialized equipment, as is the case with prior art modified fibers. In preferred embodiments, the fibers of the present invention are cylindrical in shape, i.e., they preferably have cross-sections which are circular in nature.

The fibers of the present invention are preferably composed of a hard polymer and an elastomeric polymer. The terms "hard" and "elastomer" or "elastomeric", as these terms are used herein in reference to the polymeric components of the present fibers, are intended to have their art-recognized meanings, as exemplified in U.S. Pat. No. 3,111,805, the disclosures of which are hereby incorporated herein by reference, in their entirety. Thus, the term "hard", as used herein, generally refers to those polymers and fibers prepared therefrom which may have a maximum elongation of about 80% before rupture or breakage, i.e., elongation which is substantially recoverable upon release of tension. Preferred hard polymers and/or fibers include those which may stretch no more than about 20% to about 40%, and which may have an initial modulus of from about 18 to about 85 grams per denier (gpd). Elongation may be distinguished from the permanent or substantially permanent extension of the hard portions of the fibers by drawing, as discussed in detail below. Suitable hard polymers include those which may be capable of being drawn, i.e., being extended permanently or substantially permanently, at temperatures of from about 50° C. to about 150° C. and from about 1.5 to about 10 times their original length.

A wide variety of hard polymers are available for use in connection with the present fibers and methods, and the particular polymer selected depends, for example, on the elastomeric polymer employed, the preparatory methods selected, and the intended end-use. Hard polymers which may be useful in accordance with the present invention include, for example, polyarnide polymers, such as poly (caprolactam) polyarnide (i.e., nylon 6).

The term "elastomer" or "elastomeric", as used herein, generally refers to polymers and fibers prepared therefrom which may be characterized by having a recoverable elongation of from about 100 to about 800% before breaking, and preferably have a modulus, i.e., a stress required to stretch the fiber 100%, of from about 0.01 to about 0.1 gpd. Such fibers may be characterized by a high tensile recovery, i.e., recovery to the original untensioned condition. Elastomers which are suitable for use in the fibers of the present invention include those which are prepared from substantially linear elastomeric polymers which may be extended in filamentary form and capable of being elongated at least about 100% before breaking and are not appreciably permanently elongated when stretched at temperatures from about 50° C. to about 150° C.

As with the hard polymers, a wide variety of elastomeric polymers are available for use in connection with the present fibers and methods. The particular elastomeric polymer selected depends, for example, on the hard polymer employed, the preparatory methods selected, and the intended end-use. Broadly speaking, preferred elastomeric polymers include those which, when bonded to the hard polymeric constituent, provide desirable stretch and stress recovery after drawing to provide advantageous helical crimp upon release of tension. Preferred elastomeric polymers include also those elastomeric polymers having a Type D Shore Hardness which ranges from about 40 to about 70, and all combinations and subcombinations of ranges therein. More preferably, the elastomeric polymer has a Type D Shore Hardness of about 50 to about 60, with elastomeric polymers having a Type D Shore Hardness of about 55 being even more preferred.

Elastomeric polymers which may be useful in accordance with the present invention include polymers of the polyarnide and/or polyester type. Exemplary polyarnide polymers include polyether block polyarnide copolymers. An example of a polyether block polyarnide copolymer which is particularly suitable for use in the present fiber compositions is Pebax®5533 which is commercially available from Elf Atochem North America Inc. of Philadelphia, Pennsylvania. Exemplary polyester polymers include polycaprolactone polyesters, as exemplified by Pellethane®2102, which is commercially available from Dow Chemical Co. of Midland, Mich.

Other hard and elastomeric polymers which can be employed in the present fibers would be apparent to one skilled in the art, once armed with the teachings in the present disclosure. Generally speaking, it is preferable to select polymers which have a similar chemical nature, thereby minimizing or avoiding debonding between the two components of the biconstituent fibers during processing and use.

The hard and elastomeric polymers may be melt-spun as a monofilament fiber, or they may be processed into multifilament yarns. In preferred form, the polymers may be melt spun into multifilament yarns in which the number of individual fibers ranges from about 2 to about 34, and all combinations and subcombinations of ranges therein. More preferably, the polymers may be melt spun into multifilament yarns composed of from about 2 to less than about 34 individual fibers including, for example, about 30, 25, 20 20, 15 or 10 fibers. Even more preferably, the polymers may be melt spun into multifilament yarns composed of from about 2 to less than about 10 individual fibers, for example, about 6 fibers. In particularly preferred embodiments, the polymers may be melt spun into multifilament yarns composed of about 2 fibers. Also in preferred form, the fibers and/or multifilament yarns described herein may have a tenacity of at least about 2.5 grams per denier (gpd), with tenacities of from about 2.7 gpd or greater being more preferred.

The fibers of the present invention may be prepared from the hard and elastomeric polymers using conventional melt spinning techniques which would be apparent to one skilled in the art, once armed with the teachings of the present disclosure. Generally speaking, the polymers may be melt spun using conventional side-by-side spinning techniques. A spinneret which may be employed in the melt spinning methods for preparing the present fibers is depicted schematically in FIG. 1. Referring to FIG. 1, there is provided a spinneret 10 which includes a passage 12 through which the hard polymer may be extruded and a passage 14 through which the elastomeric polymer may be extruded. Alternatively, hard polymer may be extruded through passage 14 and elastomeric polymer may be extruded through the passage 12. After extrusion through the spinneret 10, the polymers may be combined and extruded through the spinneret orifice 16 to form fibers of the present invention. To prepare multifilament yarns, the melt spinning methods may involve the use of multiple spinnerets according to techniques which would be readily apparent to the skilled artisan, based on the present disclosure. After passing through the spinneret, the fiber(s) may be quenched in air in a conventional manner and finish may be applied.

The individual hard and elastomeric polymers employed in the present fibers typically possess different physical properties including, for example, different melting temperatures, different degradation temperatures and different melting viscosities. Thus, depending on the particular polymers employed, it may be preferable to melt the hard and elastomeric polymers separately, which may then be conveyed to the spinneret. Preferred temperatures for use in the melt spinning methods may vary, depending, for example, on the particular polymers selected, the design of the spinneret, and the like. Such operating temperatures may be readily determined by one skilled in the art once armed with the teachings herein, without undue experimentation.

As known to the skilled artisan, when polymers having different melt viscosities are spun from the same spinneret hole in eccentric arrangement, a phenomenon known as "kneeing" or bending of the extruding molten filament may occur. To avoid this problem, the techniques described, for example, in U.S. Pat. No. 3,536,802, may be employed. The disclosures of U.S. Pat. No. 3,536,802 are hereby incorporated herein by reference, in their entirety.

The relative quantities of hard and elastomeric polymers which are incorporated in the fibers may vary, depending for example, on the particular polymers employed. Broadly speaking, the volume percent ratio of hard polymer to elastomeric polymer in the present fibers may range from about 70:30 to about 30:70, and all combinations and subcombinations of ranges therein. Preferably, the volume percent ratio of hard polymer to elastomeric polymer in the present fibers may range from about 57:43 to about 43:57, with a ratio of about 52:48 being more preferred.

As discussed in detail above, the present fibers are advantageously self-crimping. This means that crimp may be imparted to the fibers, for example, by drawing the fibers without application of heat or the use of swelling agents. To impart the desired crimp, the fiber may be preferably drawn at a draw ratio of at least greater than about 1 time its length (i.e., 1×). In preferred embodiments, the fiber may be drawn at a draw ratio ranging from about 1.5× to less than about 3×, and all combinations and subcombinations of ranges therein. More preferably, the fibers may be drawn at draw ratios from about 1.5× to about 2.5×, with draw ratios of about 2× being even more preferred. As would be apparent to the skilled artisan, once armed with the teachings of the present disclosure, crimp may be imparted to individual fibers by drawing unitary (i.e., single) strands of fiber or, alternatively, crimp may be imparted to yarns assembled from two or more fibers by drawing the yarns themselves.

The self-crimping fibers described herein may be advantageously incorporated into textile articles, such as hosiery, having superior wear properties, including high power, excellent fit and recovery, and unusually wide fit ranges. If desired, additional crimp may be imparted to the fibers and yarns after knitting by an aqueous treatment at or near boiling at atmospheric pressure, such as is used in conventional dyeing processes.

It has been surprisingly and unexpectedly found that by drawing the fibers greater than about 1×, and at least about 1.5×, the hard polymer portion of the fibers desirably stabilizes at a length which is greater than the length of the fiber as originally melt spun. Preferably, the residual elongation in the stretched fiber is greater than about 50%. More preferably, the residual elongation in the stretched fiber ranges from about 60 to about 120%, and all combinations and subcombinations of ranges therein. Even more preferably, the residual elongation in the stretched fiber is from about 70 to about 100%. When the tension in the stretched fibers is released, for example, by unwinding from the package, the stretched elastomeric side retracts causing helical crimps to develop in sections of alternating S and Z directions. The resulting helical crimp has unusually high power as well as a high degree of stretch. Fibers according to preferred embodiments of the present invention can be knit and processed in a fashion similar to that of 100% hard yarns.

After drawing, the fibers and/or yarns may be packaged directly, preferably with a suitable tension to maintain a desirably stable package. Substantially no sticking between the elastomeric portions of fibers may be observed during processing or after packaging of the fibers. Accordingly, the methods of the present invention may be highly simplified as compared to prior art methods, especially prior art methods which involve the use of sheath-core arrangements to avoid sticking between the elastomeric portions of fibers. The methods of the present invention are highly convenient and advantageous in that the fibers may be spun, drawn and packaged in a continuous one-step process since sticking between elastomeric portions of the fibers may be desirably avoided and since there may be no need for the use, for example, of hot relaxing zones to impart crimping.

The present fibers may be woven or knitted into textile articles according to procedures well-known to the skilled artisan. The present fibers and multifilament yarns may be knitted with about the same handling as with conventional yarns. Exemplary textile articles which may be prepared from the present fibers include hosiery, pantyhose, stockings, panties, sportswear, and the like, with hosiery, especially ladies hosiery being preferred. Textile articles which may be obtained from the present fibers, particularly hosiery, may be desirably compact and substantially shorter than corresponding textile articles prepared from hard yarns or prior art bicomponent yarns. The textile articles may also be substantially pick-resistant and snag-resistant in view of the crimp which spontaneously develops in the greige article. The use of steaming or autoclaving may be advantageously avoided with the present fibers to achieve a superior crimp and greige fabric compactness for ease of handling and high yield of the knitted article.

Exemplary knitting methods for preparing the textile articles may involve, for example, knitting multifilament yarns on conventional 400 needle, four feed knitting machines at up to about 800 revolutions per minute. A light tension, for example, about 1 gram, may be employed during knitting.

EXAMPLES

The invention is further described in the following examples. These examples are for illustrative purposes only, and are not to be construed as limiting the appended claims. All of the examples are actual examples.

Example 1

This example includes a description of the preparation of fibers, composite filamentary yarn and knitted fabrics and hosiery products.

A. Preparation of Fiber and Filamentary Yarn

A continuous 22 denier, two filament bicomponent yarn (also designated by the shorthand notation "22-2" yarn, where "22" indicates the denier and "2" indicates the number of individual filaments) was melt spun in a side-by-side configuration containing about 50:50 hard polymer-:elastomeric polymer (i.e., about 50% by volume of a hard polymer and about 50% by volume of an elastomer). The hard polymer was a fiber grade nylon 6 which is a polycaproamide with a melting point of 220° C. and a specific gravity of 1.13 gm/cc. The elastomer was PEBAX®5533 SA01 which is composed of an eleven carbon polyarnide containing blocks of polyether. The hard and elastomeric polymers were melted separately and conveyed to a distribution plate and spinneret at 285° C. for the nylon 6 and 185° C. for the elastomer. After entering the distribution plate, the time to extrusion from the spinneret orifice was less than 10 seconds. The polymers were combined in a spinneret having a "Y" shaped configuration, as depicted in FIG. 1. The spinneret metal temperature at the orifices was 250° C. The resulting filaments were quenched in a 2½ meter zone and finish was metered to the thread line prior to the feed roll. The thread line was drawn 2.0× in a continuous fashion without application of heat and wound-up at 800 meters/minute. When removed from this package, the wound yarn exhibited a crimp stretch of 65%.

B. Preparation of Knitted Articles

Yam wound and packaged in Step A was knit on a four feed tubular hosiery knitting machine using a tension similar to that used in knitting non-elastic hard yarn (i.e., approximately 1 gram). The fabric was formed by knitting subsequent rows of plain loops in a tubular format using approximately 400 needles to form wales from the yarn. Knitting speed was 800 rpm. The fabric was then dyed at approximately 210° F. for 30 to 40 minutes. The dyeing process subjected the fabric to a set at 210° F.

Hosiery products produced from the above yarn were of superior fit comfort, fit retention and fit range (see testing procedures below). An additional advantage provided by this yarn was that the hosiery products as first knit were crimped and shorter than normal (see testing procedures below) and therefore were easier to process and resisted picking and snagging during processing. A further advantage of the present yarn was that hosiery products provided by the present yarn could be boarded (i.e., heat set on boards) at 250° F. to yield a flat hose with excellent appearance for packaging and without loss of other hose attributes.

Example 2

Example 1 was repeated except a spinneret with six holes (0.012 inch diameter) was used to produce a 20 denier yarn of six filaments ("20-6" yarn). The volume ratio of hard polymer to elastomer was 60:40. The yarn was drawn and wound as described in Example 1. The yarn exhibited a crimp stretch of 69% upon removal from the package.

The fabric obtained from this yarn exhibited similar attributes as described in Example 1 except that it possessed improved softness.

Example 3

This example includes a comparative analysis of the physical properties of hosiery prepared from fibers according to the present invention and hosiery prepared from fibers of the prior art.

A. Comparative Testing for Fit, Fit Range and Fit Retention

Comparative analysis testing procedures were conducted to measure fit, fit range and fit retention. The test procedures involved stretching in a transverse direction samples which were cut from hosiery just above the knee area to contain 300 courses in the form of a tube. The tube was placed around two ¼ inch diameter horizontal bars, one of which was attached to the crosshead of an Instron tester and the other of which was attached to the Instron load cell. The samples were stretched by the Instron until the load reached 100 grams. The amount of increase in circumference of the sample between 50 and 100 grams was an indicator of fit range. An increase of less than about 1.4 inches was considered an indication of undesirably poor fit range.

The sample was held in a stretched condition for five minutes, and the loss in tension during the five minute period was observed. A loss in tension of greater than 28 grams was considered an indicator of poor fit retention.

After the five minute stretching period, the circumference of the sample was increased two inches to simulate the effect of sitting or knee bending. The resulting tension was recorded. A tension of greater than 200 grams was considered an indicator of undesirably high tension or pressure on the leg, as well as poor fit and fit range. The stretch between 100 and 200 grams was also measured as a further indication of fit range. If the two inch increase in circumference resulted in a tension of less than 200 grams, the slope of the curve of tension versus stretch was extrapolated to 200 grams. A stretch between 100 and 200 grams of less than 2 inches was considered an indicator of poor fit range.

The sample was held in the stretched position for two minutes, the additional two inch stretch was removed, and the resulting tension was recorded. A tension below 20 grams was considered an indicator that the hose would be loose fitting and possibly subject to bagging. The results of the comparative analysis are set forth in Table 1 below.

TABLE 1

| Sample | Sample Description | Increase in Circumference 50–100 grams (inches) | Loss in Tension After 5 mins (grams) | Tension After 2" Additional Increase in Circumference (grams) | Increase in Circumference 100–200 grams (inches) | Initial Tension Upon Removal of Added 2" Stretch (grams) |
|---|---|---|---|---|---|---|
| 3A | Side-by-side fibers of Example 1 (22-2) | 4.0 | 19 | 122 | 4.9 | 52 |
| 3B | Side-by-side fibers of Example 2 (20-6) | 3.4 | 25 | 125 | 4.4 | 43 |
| 3C | Sideria (18-2) eccentric sheath core (nylon 66/polyurethane) | 1.6 | 37 | 158 | 2.2 | 18 |
| 3D | Nylon 66 torque set in alternating S and Z twists (15-1) | 1.0 | 37 | 273 | 1.0 | 18 |
| 3E | Torque textured nylon (20-7) | 2.8 | 14 | 123 | 5.2 | 25 |
| 3F | Differential shrinkage, side-by-side 18-8-783 nylon | 2.0 | 30 | 160 | 2.6 | 20 |
| 3G | 20 Denier Spandex single covered with 18-8-783 and 20-7 uncrimped nylon in alternate courses | 1.4 | 35 | 185 | 2.2 | 43 |
| 3H | 10 Denier Spandex double covered with 7-5 uncrimped nylon | 1.4 | 22 | 160 | 3.0 | 37 |
| 3I | 15 Denier Spandex plaited with 15-3 nylon in alternate courses | 1.8 | 24 | 162 | 2.0 | 35 |

Inspection of the data tabulated in Table 1 reveals that hosiery products knitted from fibers of the present invention possess unexpectedly improved properties, as exemplified by their high power, excellent fit and recovery, and unusually wide fit range, as compared to hosiery products knitted from prior art fibers. As discussed above, the use of sheath-core technology, as exemplified in Sample 3C, is generally highly disadvantageous in that it is often extremely difficult to control sheath thickness and eccentricity, and variations in sheath thickness frequently result in non-uniform crimping and dyeing which, in turn, reduces yields of the manufactured yarns. Sheath-core technology also requires highly complex and expensive sheath core spinning equipment and processes, as compared to the fibers of the present invention which may be manufactured with conventional melt-spinning equipment for side-by-side filaments. Also as discussed above, the use of covering or plaiting technology generally provides yarns which are difficult to knit.

B. Comparative Testing for Crimp Development

Comparative analysis testing procedures were conducted to measure crimp development in yarns containing fibers of the present invention and yarns of the prior art. The test procedures involved unwinding yarns from the knitting supply package under the minimum tension required to straighten all crimp (approximately 0.3 gpd). The load on a 4 inch length of the extended yarn was then reduced to 0.024 g and the crimped length ($CL_1$) was measured. The percent crimp stretch was then calculated according to the equation: % Crimp Stretch=$100\times(4-CL_1)/4$. The results of these comparative testing procedures are set forth in Table 2 below.

TABLE 2

| Sample | % Crimp Stretch |
|---|---|
| Example 1 | 65 |
| Example 2 | 69 |
| 18-2 Sideria | 8 |
| 18-8-783 nylon | 8 |
| 20-7 textured nylon | 50 |

The data in Table 2 reveals that yarns containing fibers of the present invention develop desirably high crimp upon removal from the knitting packages as compared to yarns of the prior art.

C. Comparative Testing for Greige and Finished Hose Length

Comparative testing procedures were conducted to measure greige and finished hose lengths in hosiery prepared from fibers of the present invention and yarns of the prior art. The testing procedures involved hosiery blanks whose measurements were based on the length of the hose below the panty when knitting legs for medium size hose, as measured within 1 hour of knitting. The results of the comparative testing procedures are tabulated in Table 3 below.

TABLE 3

| Yarns | Blank Length as Knit (inches) | Blank Length after boil at 210° F. (inches) |
|---|---|---|
| Example I | 30 | 22 |
| 18-2 Sideria | 40 | 30* |
| 15-1 torque textured alternate course nylon | 28 | 21 |
| 18-8-783 yarn | 36 | 30 |

Inspection of the data in Table 3 reveals that the fibers of the present invention provide greige hosiery which contracts to a small easily handled size. In addition, no additional crimp development treatment is required to achieve crimp development and fabric properties necessary to satisfy premium hosiery standards, as is generally the case with prior art fibers. Although 15-1 torque textured alternate course nylon demonstrates good greige and finished hose lengths, this yarn is manufactured using torque technology which, as discussed above, is generally highly disadvantageous in that torque yarns generally have low fit range, poor recovery and exhibit noticeable stitch definition. These poor wear properties, as measured by fit, fit range and fit retention for 15-1 torque textured alternate course nylon are set forth in Table 1 above.

D. Overall Comparative Testing

The fibers and knitted products of the present invention were compared to fibers and knitted products of the prior art based on various aspects, including fiber preparatory methods, hosiery preparatory methods, and finished hosiery attributes. The results of this comparison are set forth in Table 4 below. In Table 4, "+" means advantage, "0" means equivalent, "−" means disadvantage and "NA" means not applicable.

TABLE 4

| Fiber Preparatory Methods | Example 1 | Sideria | 15-1 torque | 20-7 textured | 20 denier Lycra single cover | 10 denier Lycra double cover | 15 denier Lycra plaited |
|---|---|---|---|---|---|---|---|
| One step vs multi-step | + | − | − | − | − | − | − |
| Side-by-side vs sheath core | + | − | NA | NA | NA | NA | NA |
| Added treatment not required after spinning | + | − | − | − | − | − | − |
| Hosiery Preparatory Methods | | | | | | | |
| Ease of knitting | + | 0 | 0 | + | − | − | − |
| Altemate course knitting unnecessary to balance torque | + | + | − | − | − | + | + |
| Length of Greige hose | 0 | − | 0 | + | + | + | + |
| Autoclaving unnecessary | + | − | − | + | + | + | + |
| Crimp level after steaming | + | + | + | 0 | 0 | 0 | 0 |
| Ability to board | + | − | + | − | + | + | − |
| Finished Hosiery Attributes | | | | | | | |
| Fit comfort | 0 | − | − | 0 | + | + | − |
| Fit range | 0 | − | − | 0 | + | + | + |
| Fit retention | 0 | − | − | 0 | + | + | + |
| Hand | 0 | 0 | − | + | + | + | + |
| Sheerness | + | + | + | − | − | − | − |
| Durability | 0 | 0 | − | − | + | + | + |

The comparative data in the above Table 4 reveals that the fibers of the present invention, as exemplified by the fiber prepared in Example 1, are superior overall to fibers of the prior art. In particular, the preparatory methods for the present fibers are superior to preparatory methods for prior art fibers in that the present methods may be single step as opposed to multi-step, and the fibers may be prepared in a side-by-side arrangement. In addition, generally no additional crimping development treatment is needed. The meth ods for preparing hosiery from the present fibers are superior in all categories to prior art methods evaluated in the comparative testing procedures except in the length of greige hosiery where they are superior to the sheath core arrangement of Sideria and equivalent to the 15/1 torque product. The finished hosiery products provided herein are also superior or equivalent to hosiery prepared from fibers incorporating the sheath core technology (e.g., Sideria) and the 15/1 torque product, while being superior to all other prior art hosiery involved in the comparative testing in sheerness.

Example 4

This example includes a description of testing procedures which were conducted to analyze the effect of altering the draw ratio (i.e., the length the fiber is drawn, relative to its length). The testing procedures employed a 22 denier, two filament yarn as prepared in Example 1, employing an 800 meters/minute winding speed. The first take-up roll after quenching the filaments was varied in speed to produce draw ratios from 1.5× to 3.5×. The properties of the variously drawn filaments were then analyzed, and the results are tabulated in Table 5 below.

TABLE 5

| Draw Ratio | % Crimp Stretch | % Residual Elongation | Tenacity gpd | Denier | Relaxed Area of Knit Hose* Before Boiloff | After Boiloff |
|---|---|---|---|---|---|---|
| 1.5× | 69 | 142 | 2.5 | 22.8 | 15.7 | 14.0 |
| 2.0× | 64 | 93 | 2.7 | 22.2 | 16.2 | 12.4 |
| 2.5× | 63 | 72 | 2.8 | 22.7 | 24.2 | 13.5 |
| 3.0× | 56 | 53 | 2.8 | 24.2 | 30.1 | 12.7 |
| 3.5× | 41 | 40 | 2.8 | 25.6 | 32.8 | 15.0 |

*Section of hose containing 600 courses in the knee area.

Inspection of the data in Table 5 above reveals that the fibers of the present invention are self-crimping and possess properties suitable for use in premium hosiery products without the use of additional treatment methods to impart crimp. Preferred fiber properties were obtained with draw ratios ranging from 1.5× to 2.5×.

The disclosures of each patent, patent application and publication cited or described in this document are hereby incorporated herein by reference, in their entirety.

Various modifications of the invention, in addition to those described herein, will be apparent to those skilled in the art from the foregoing description. Such modifications are also intended to fall within the scope of the appended claims.

What is claimed is:

1. A fiber which comprises a non-elastomeric polyarnide and a thermoplastic elastomer selected from the group consisting of a polyether block polyarnide copolymer and a polycaprolactone polyester, wherein the fiber is self-crimping.

2. A fiber according to claim 1 which has a circular cross-section.

3. A fiber according to claim 1 wherein said non-elastomeric polyarnide and said thermoplastic elastomer are in a side-by-side arrangement.

4. A fiber according to claim 1 wherein said non-elastomeric polyarnide is nylon 6.

5. A fiber according to claim 1 wherein said thermoplastic elastomer comprises a polyether block polyarnide copolymer.

6. A fiber according to claim 1 wherein said thermoplastic elastomer comprises a polycaprolactone polyester.

7. A multifilament yarn comprising fibers according to claim 1.

8. A textile article comprising fibers according to claim 1.

* * * * *